United States Patent [19]

Boynton

[11] Patent Number: 4,467,503

[45] Date of Patent: Aug. 28, 1984

[54] ENLACEABLE SERVIETTE

[76] Inventor: Stephanie W. Boynton, 6465 Danette St., Simi Valley, Calif. 93063

[21] Appl. No.: 477,167

[22] Filed: Mar. 21, 1983

[51] Int. Cl.[3] ..... A47G 11/00

[52] U.S. Cl. ..... 24/7; 24/117; 150/52 C; 206/553

[58] Field of Search ..... D6/266; 24/7, 8, 9; 2/49 R, 117; 428/4, 223, 99, 225; 150/524; 206/553

[56] References Cited

U.S. PATENT DOCUMENTS

| | | | |
|---|---|---|---|
| 1,679,101 | 7/1928 | Sternthal | 150/52 C |
| 1,879,259 | 9/1932 | Howard | 428/136 |
| 2,470,367 | 5/1949 | Palma | 428/473 X |
| 2,803,574 | 8/1957 | Payant | 428/134 X |
| 3,833,937 | 9/1974 | Taylor | 2/49 R X |
| 4,177,846 | 12/1979 | Rountree | 24/7 X |

FOREIGN PATENT DOCUMENTS

| | | | |
|---|---|---|---|
| 205217 | 10/1923 | United Kingdom | 2/49 R |

*Primary Examiner*—Henry F. Epstein
*Attorney, Agent, or Firm*—Donald G. Lewis

[57] ABSTRACT

The invention is an enlaceable serviette. An enlaceable serviette is a serviette which includes the means to enlace and secure a decorative pattern of folding. The basic enlaceable serviette includes only a napkin and a tie integrally attached to the napkin. The napkin is foldable into a decorative pattern suitable for presentation as a decorative piece at a table setting. The decorative pattern may be enlaced and secured by the tie which can be wrapped around the folded napkin and fastened. To use the serviette during a meal, the diner unfastens the tie and unfolds the serviette. The tie can also serve to secure the folding pattern of the napkin during storage and handling. The enlaceable serviette is particularly useful in institutional situations where large numbers of serviettes are used. The integral attachment of the tie to the serviette prevents its separation and possible loss during laundering, during handling and storage, and during the meal. The enlaceable serviette can also include a decorative patch attached to the napkin. The decorative patch may enhance the fastness of the tie or may direct the enlacement of the tie. Also, the decorative patch may organize and indicate the folding pattern of the napkin.

8 Claims, 10 Drawing Figures

Fig.1.
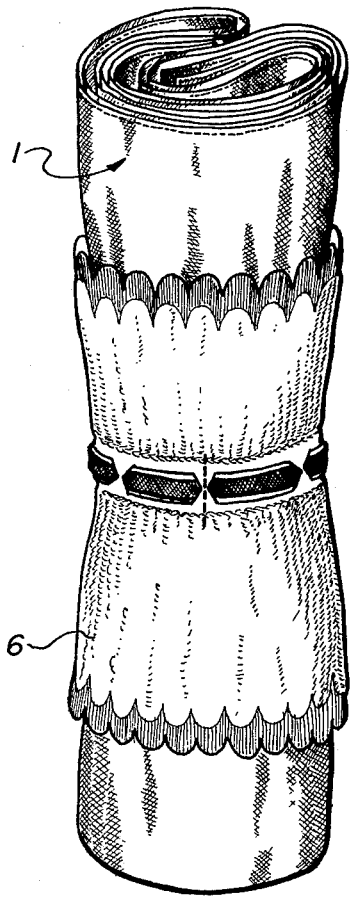
Fig.2.
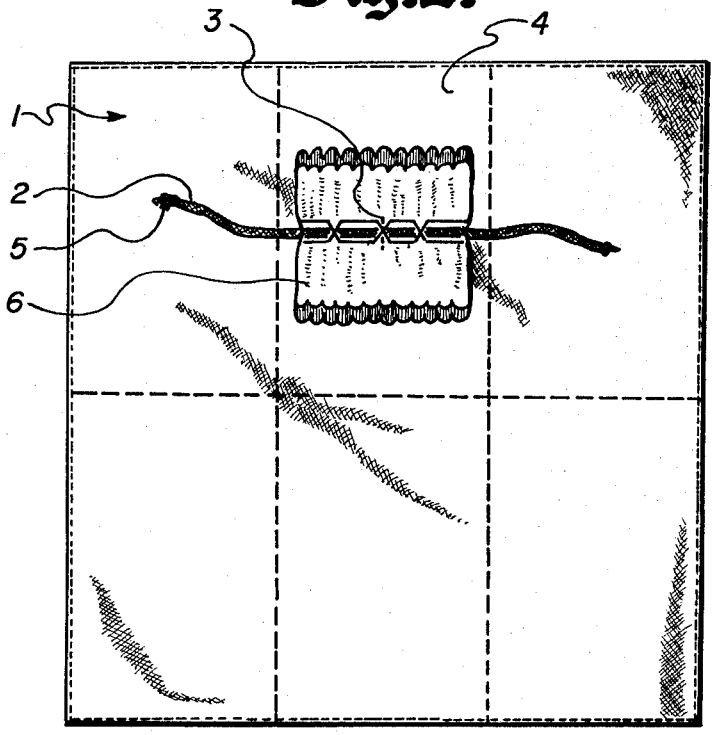
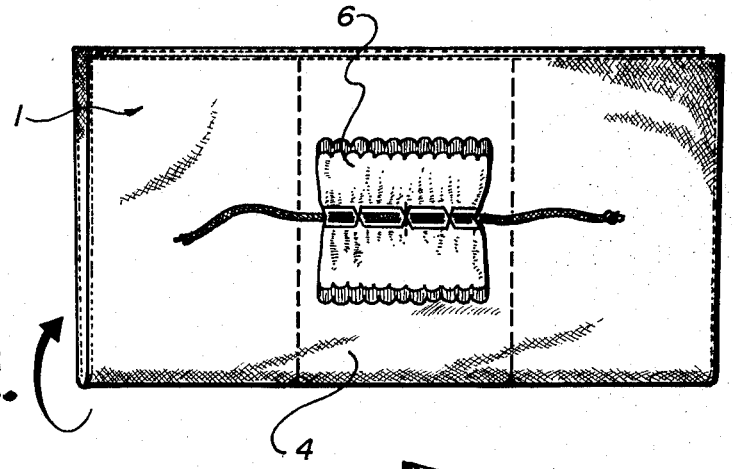
Fig.3.
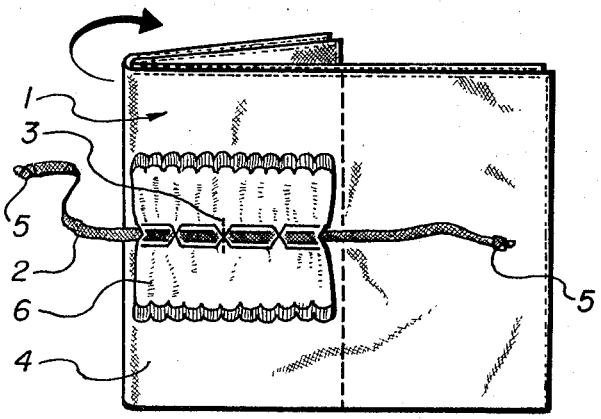
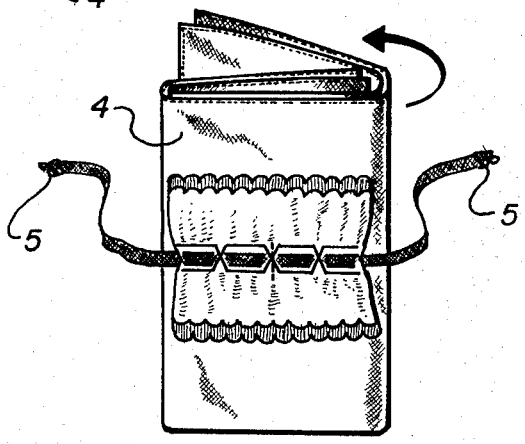
Fig.4.
Fig.5.

ENLACEABLE SERVIETTE

BACKGROUND

The invention relates to serviettes which can be folded into a decorative pattern and which can be retained in the decorative pattern for presentation at a table setting and for handling. At the beginning of a meal, the diner releases the retainer which holds the decorative pattern and unfolds the serviette for use during the meal.

Serviettes may be folded into simple decorative patterns which do not require a retainer to hold the pattern for presentation at a table setting. For example, a serviette folded by two or three doublings typically will not require a retainer for presentation at a table setting. The decorative quality of such patterns is minimal. The handling of serviettes folded into such patterns would benefit from the use of a retainer.

Serviettes may be folded into patterns which are self retaining, i.e. a property of the folded pattern itself holds the pattern together. Serviettes folded into such self retaining patterns do not require separate retainers to hold the decorative pattern. However, without a retainer, the repertoire of folded patterns are limited to such self retaining patterns or to patterns otherwise not requiring a retainer for presentation. Also, many self retaining folded patterns require a skill which must be learned by the person folding the serviette. The fastness of the self retaining pattern is a property of the particular pattern and is a matter of degree. Aesthestically desirable patterns may not be self retaining or may not have the desired degree of fastness.

Napkin rings and fasteners are commonly used to retain decorative folding patterns. When folded and retained by a napkin ring or fastener, the serviette may be stored or displayed in a wide variety of patterns which are aesthestically desirable or which facilitate handling, but which could not be used without the napkin ring or fastener. Napkin rings and fasteners are not integrally attached to the serviette which they retain. The enlaceable serviette differs from the combination of a serviette and a napkin ring or fastener because the enlaceable serviette includes an integrally attached tie which serves to retain the folded pattern of the serviette. Rings and fasteners are easily separated from the serviette and lost when the serviette is unfolded and used by the diner or when it is laundered and stored.

Some dining bibs include both a napkin part and an integrally attached tie string. The integrally attached tie string is long enough to encircle the diner's neck in order to secure the position of the napkin part beneath the diner's chin. The bib tie string is attached to the upper edge of the napkin, adjacent to the chin. Also, the tie string is directed by its attachment to the edge of the napkin so as to point away from the napkin and so as to loop around the diner's neck. The tie string of the bib is not used for enlacing and retaining a decorative folding pattern of the napkin part. The length of the tie string, its attachment at the upper edge of the napkin, and the direction of its attachment preclude its effective use as a tie for enlacing and securing a decorative folding pattern of the napkin.

SUMMARY

Definitions:

(1) Enlaceable—capable of being encircled or enfolded, i.e., capable of being enlaced.

(2) Serviette—a table napkin.

The invention is an enlaceable serviette. An enlaceable serviette may be used both during a meal and as a decorative piece for presentation at a table setting. The simplest version of the enlaceable serviette includes only a foldable cloth napkin and a tie which is integrally attached to the cloth napkin. The tie is long enough to encircle the folded cloth napkin and serves to enlace and secure the folded napkin. Prior to a meal, the napkin is folded and enlaced into a decorative pattern suitable for a table place setting. The tie is then wrapped around the decoratively folded napkin and knotted or otherwise fastened in order to secure the decorative pattern of the napkin and to facilitate its handling. During a meal, the diner unfastens the tie in order to release and to unfold the napkin. The unfastened tie remains an integral part of the enlaceable serviette and remains permanently attached to the unfolded napkin during the meal.

The enlaceable serviette is useful as a napkin. However, it is also useful because of the ability of the tie to be wrapped about and to secure the decorative pattern of the folded napkin for use at a table setting. The enlaceable serviette is also useful because the enlacement facilitates the handling of large numbers of folded serviettes. This advantage is particularly important in institutional situations. The enlaceable serviette is also useful because the permanent attachment of the tie to the serviette serves to prevent the separation and loss of the tie during the meal, during laundering, or during handling and storage.

A more decorative version of the enlaceable serviette may also include a decorative patch which is sewn on or otherwise attached to the cloth napkin. The decorative patch may serve to mask the point of attachment of the tie to the napkin. The decorative patch can also serve to help indicate and organize the folding pattern of the napkin. The decorative patch may also help the tie to enlace the folded napkin. A more decorative version of the enlaceable serviette may also include permanent creases within the napkin in order to facilitate its folding into a predetermined pattern.

The enlaceable serviette is moved because it is the first integrally sufficient serviette which can be decoratively folded into patterns which require enlacement and which also includes an integrally attached tie which serves to enlace the folded pattern.

BRIEF DESCRIPTION OF THE DRAWINGS

FIG. 1 is a view in perspective of an enlaceable serviette which is shown folded, enlaced, and tied and which is ready for presentation at a table setting.

FIG. 2 is a view in perspective of the enlaceable serviette of FIG. 1 reduced in size showing the enlaceable serviette untied and completely unfolded in its open position, ready for use during a meal and indicating the folding pattern by dashed lines.

FIG. 3 is a view in perspective of the open enlaceable serviette of FIG. 2 showing the enlaceable serviette partially refolded by doubling the enlaceable serviette from its open position of FIG. 2.

FIG. 4 is a view in perspective of the enlaceable serviette of FIG. 3 showing the enlaceable serviette with a further fold from FIG. 3.

FIG. 5 is a view in perspective of the enlaceable serviette of FIG. 4 showing the enlaceable serviette with a final fold.

DETAILED DESCRIPTION

The basic enlaceable serviette includes only a napkin (1) and a tie (2). The tie (2) is integrally attached to the napkin (1). The napkin (1) is best made of linen cloth, although most other commonly used napkin materials may also be used with the enlaceable serviette. The tie (2) is best made of cord or lace type materials. However, any material which can serve to enlace may also be used to make the tie (2).

The napkin (1) should be of the type which can be decoratively folded. The invention includes any and all types of decorative folding for serviettes. FIG.'s 2, 3, 4, and 5 illustrate one example of a relatively simple folding pattern. Folded serviettes are generally more easily handled in large numbers if they are each secured by enlacement. Also, the enlacement can be essential to the decorative quality of some elaborately folded serviettes which have folding patterns which require enlacement.

The tie (2) may be attached to the napkin (1) by stitches (3) as illustrated in FIG.'s 8 and 9. Most commonly, the tie (2) will be attached to an interior region (4) of the napkin so as to maximize the fastness of the tie (2) as it encircles and secures the folding pattern of the serviette. The invention includes any form of integral attachment between the napkin (1) and the tie (2). Integral attachment includes permanent attachment or any attachment which is sufficiently secure to prevent loss of the tie (2) due to detachment or separation during normal laundering, handling, or use.

Figure 6:
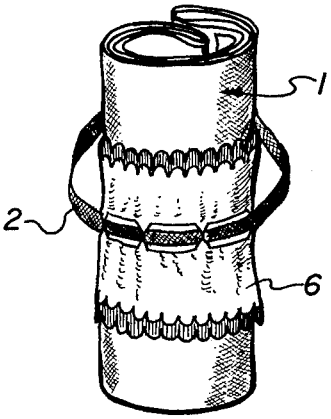
FIG. 6 is a view in perspective of the enlaceable serviette of FIG. 5 showing the folded enlaceable serviette being enlaced.
Figure 7:
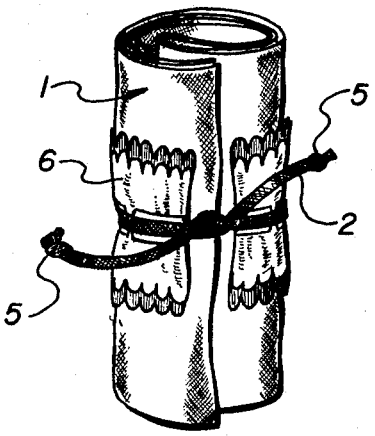
FIG. 7 is a view in perspective of the back side of the enlaceable serviette of FIG. 6 showing the folded enlaceable serviette being tied.
Figure 8:
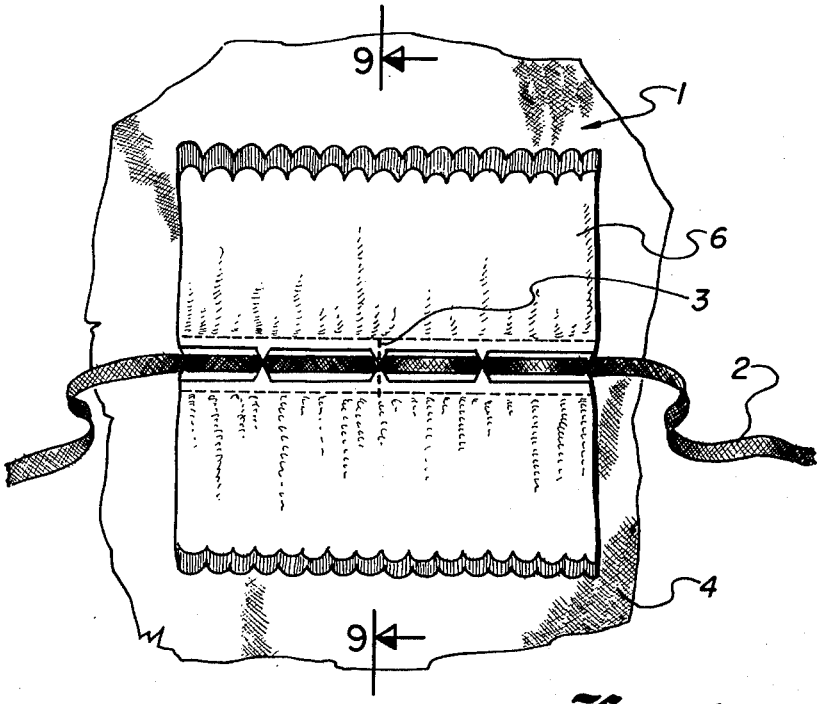
FIG. 8 is a fragment of an enlarged view in perspective of the enlaceable serviette of FIG. 2 showing the decorative patch and showing the detail of the integral attachment of the tie to the napkin.
Figure 9:
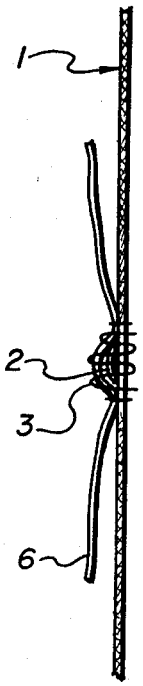
FIG. 9 is a sectional view of FIG. 8 showing the detail of the stitches which integrally attach the tie to the napkin.

The tie (2) must have one or more free ends (5) which act in combination to encircle and fasten the folded napkin (1). FIG.'s 6 and 7 illustrate a tie (2) with two free ends (5) encircling and fastening a folded napkin (1). The tie (2) may be fastened by knotting as in FIG. 7 or by a fastener or other fastening means. If a fastener is used, the tie may be elastic so as to stretch around the folded napkin (1) in order to hold the folded pattern securely.

Figure 10:
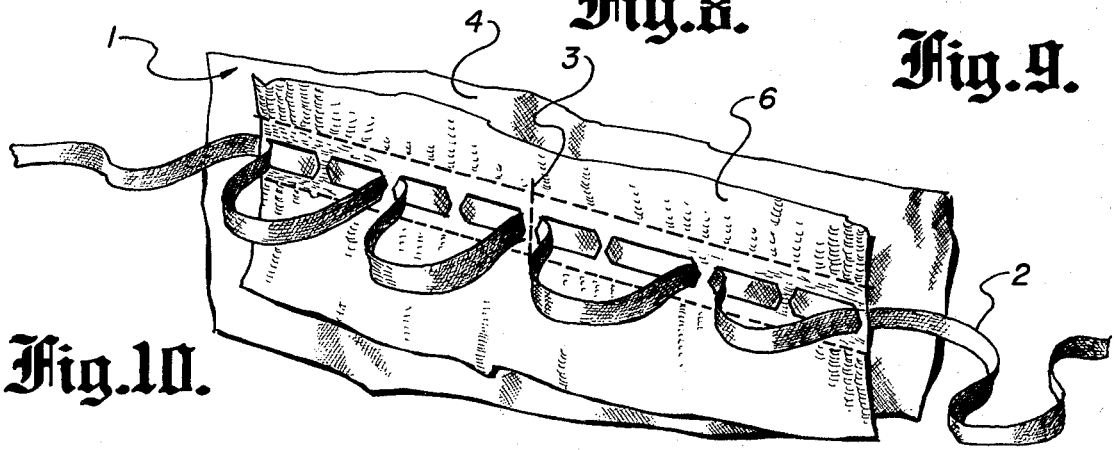
FIG. 10 is a fragment of a view in perspective of the enlaceable serviette of FIG. 8 showing the detail of the integral attachment of the tie to the napkin and showing one possible arrangement for the enlacement of the decorative patch.

A more decorative enlaceable serviette may also include a decorative patch (6). The decorative patch (6) is attached to the napkin (1) by sewing or other means. The decorative patch (6) may serve to mask the attachment of the tie (2) to the napkin (1). The decorative patch (6) may also help the person who folds the serviette by indicating and facilitating the desired folding pattern. Also, the decorative patch (6) may be used in conjunction with the enlacement. FIG. 10 illustrates one example of a decorative patch (6) which is interlaced with the tie (2) and which helps the tie (2) to enlace and secure the folded napkin (1).

Typically, the enlaceable serviette will undergo a cycle of use. The decoratively folded enlaceable serviette will be placed at a table setting; the diner will release the enlacement and unfold the enlaceable serviette; the diner will use the enlaceable serviette as a napkin during the meal; after the meal the enlaceable serviette will be removed for laundering; the enlaceable serviette will be laundered and possibly pressed; the enlaceable serviette will be refolded and enlaced; the enlaceable serviette will then be stored away before being used at the next table setting. Alternatively, the enlaceable serviette may be stored in the unfolded state and refolded just prior to reuse at the next table setting. During its cycle of use, the tie (2) always remains attached to the napkin (1). If the tie (2) were not securely attached, it could eventually become accidently separated and lost after several cycles.

I claim:

1. An enlaceable serviette, foldable into a decorative pattern for presentation at a table setting and unfoldable for use during a meal, the enlaceable serviette comprising:

a napkin foldable into the decorative pattern and a tie integrally attached to said napkin, said tie being for securing the decorative pattern by enlacing and fastening said tie being about said folded napkin, said enlaced tie unfastenable for unfolding said folded napkin for use during the meal.

2. An enlaceable serviette as in claim 1 wherein said napkin includes an interior region and wherein said tie is integrally attached to the interior region of said napkin.

3. An enlaceable serviette as in claim 1 further comprising:

an ornamental patch attached to said napkin.

4. An enlaceable serviette as in claim 1 wherein said tie comprises a lace integrally attached to said napkin, the lace having at least two free ends with a combined length sufficient both for encircling said folded napkin and for knotting, thereby securing the decorative pattern of said folded napkin.

5. An enlaceable serviette as in claim 1 wherein said tie comprises a lace and a fastener, the lace being attached to said napkin with at least one free end having sufficient length for encircling said folded napkin and connecting with the fastener, the fastener being connected to the enlaceable serviette proximate to the attachment of the lace to said napkin, the fastened and encircling lace thereby securing the decorative pattern of said folded napkin.

6. An enlaceable serviette as in claim 1 wherein said napkin is composed of cloth.

7. An elaceable serviette as in claim 1 wherein said napkin is composed of linen.

8. An enlaceable serviette as in claim 1 wherein said napkin is composed of cloth and includes an interior region and wherein said tie comprises a lace integrally attached to the interior region of said napkin has at least two free ends with a combined length sufficient both for encircling said folded napkin and for knotting, thereby securing the decorative pattern of said folded napkin, the enlaceable serviette further comprising:

an ornamental patch attached to the interior region of said napkin.

* * * * *